US006771025B1

(12) United States Patent
Fashoni et al.

(10) Patent No.: US 6,771,025 B1
(45) Date of Patent: Aug. 3, 2004

(54) MAGNETRON CONTROLLER WITH TRANSFORMER CONTROLLING THE INRUSH CURRENT

(75) Inventors: Bernard Michael Fashoni, Merseyside (GB); Paul Raymond David Wicks, Isle of Wight (GB)

(73) Assignee: United Automation Limited, Southport (GB)

( * ) Notice: Subject to any disclaimer, the term of this patent is extended or adjusted under 35 U.S.C. 154(b) by 0 days.

(21) Appl. No.: 09/869,411

(22) PCT Filed: Dec. 16, 1999

(86) PCT No.: PCT/GB99/04270

§ 371 (c)(1),
(2), (4) Date: Oct. 31, 2001

(87) PCT Pub. No.: WO00/40056

PCT Pub. Date: Jul. 6, 2000

(30) Foreign Application Priority Data

Dec. 23, 1998 (GB) ..... 9828408
Feb. 22, 1999 (GB) ..... 9903946

(51) Int. Cl.[7] ..... H05B 39/00
(52) U.S. Cl. ..... 315/105; 315/39.51; 315/291
(58) Field of Search ..... 315/105, 106, 315/107, 39.51, 291; 219/716; 363/37, 49

(56) References Cited

U.S. PATENT DOCUMENTS 3,758,815 A * 9/1973 Paget ..... 315/101
3,824,428 A * 7/1974 Spira et al. ..... 315/105
3,840,774 A * 10/1974 Iwata ..... 315/39.51
4,092,510 A 5/1978 Kiuchi et al.
4,358,729 A 11/1982 Hart
4,866,590 A 9/1989 Odaka et al.
4,988,922 A * 1/1991 Shoda et al. ..... 315/223
5,010,468 A 4/1991 Nilssen
5,053,682 A * 10/1991 Shoda et al. ..... 315/223
5,571,439 A 11/1996 Daley et al.
5,656,891 A * 8/1997 Luger et al. ..... 315/94
6,104,146 A * 8/2000 Chou et al. ..... 315/277
6,501,225 B1 * 12/2002 Konopka ..... 315/105

FOREIGN PATENT DOCUMENTS

EP 0248669 A 12/1987
GB 2197997 A 6/1988

* cited by examiner

*Primary Examiner*—Tan Ho
(74) *Attorney, Agent, or Firm*—Drinker Biddle & Reath LLP

(57) ABSTRACT

A control unit for a magnetron, the circuit being supplied form a source of a.c. voltage and comprising a power switch, a process controller/firing circuit for the power switch and first and second transformers. The first transformer supplies a desired filament voltage to the magnetron and the second transformer controls the current flow in the magnetron and hence the power output. The second transformer is controlled by the operation of the process controller/firing circuit and the power switch to provide an infinitely variable power output setting to the magnetron.

24 Claims, 1 Drawing Sheet

MAGNETRON CONTROLLER WITH TRANSFORMER CONTROLLING THE INRUSH CURRENT

FIELD OF THE INVENTION

The present invention relates to a microwave controller, and especially to a controller to control the power output of a microwave heating system but without limitation to same.

BACKGROUND OF THE INVENTION

A conventional microwave oven or any other microwave heating system operates by the use of high frequency electromagnetic waves called microwaves. A microwave oven raises the temperature of all microwave absorbent material by subjecting it to a high frequency electromagnetic field. The microwaves are absorbed by certain molecules such as water, fats and sugar whose consequence vibrations produce heat. The high frequency radiation which has a frequency of between 890 and 2,450 megahertz is generated by means of a magnetron, a type of electron tube, and this radiation is absorbed by a product to generate heat which is not just at the surface but also to a significant depth within the product that requires to be heated or cooked thus greatly reducing cooking time. The heat penetration is determined by the power of the microwave.

At present, where the power output of a conventional microwave oven is to be varied, it is controlled by pulsing the radiated output using an on/off switching technique by means of a conventional relay. This on/off or Burst Firing method as it is known is used to control the power, by using a variable mark space ratio which means that the on and off times are varied to give an average power setting. The output power is either fully on or fully off, so for a 50% power output setting the power on time could be one second and the power off time would be one second, so say over a ten second period the power output would be 50%. A mechanical relay is used to connect the primary winding of a transformer to a source of power. The transformer has two secondary windings. One supplies a filament voltage to the magnetron and the other determines the average power generated by the magnetron according to the switching frequency of the relay. Thus both of the secondary windings are switched on and off simultaneously.

From the above it will be apparent that to obtain a fine control of the power output for defrosting, slow cooking or simmering, a large number of on/off ratios would have to be used. These values would have to be stored in the microwave controller's memory to give a wide control range. Additionally, the relay contacts would burn out due to the number of switching cycles required to give good control. There are problems with relays burning out on conventional industrial microwave ovens due to their higher power requirements.

It is the aim of the present invention to provide a solution to these problems.

SUMMARY OF THE INVENTION

Accordingly, one aspect of the invention provides a control circuit for a magnetron, the circuit being supplied from a source of a.c. voltage and comprising a power switch, a process controller/firing circuit for the power switch, the circuit further comprising separate first and second transformers, the first transformer supplies a desired filament voltage to the magnetron, and the second transformer controls the current flow in the magnetron and hence the power output thereof, the second transformer is controlled by the operation of the process controller/firing circuit and the power switch.

Conveniently the first transformer is referred to as the filament transformer, and the second transformer is referred to as the power transformer. By seperating out the transformers, only the power transformer needs to be switched to control the power output. The filament transformer maintains a prescribed constant voltage across the magnetron. One advantage of separating out the transformer is that start up noise is reduced.

The problem with mechanical relay contacts can be eliminated by using solid state switching. Numerous electronic techniques may be used to control the power transformer and hence the power output of the magnetron. Two possibilities are described hereinafter, but these are not to be taken as limiting. One option is to use a burst firing technique. The other is to use a phase angle technique. The process controller/firing circuit is constructed appropriately to provide the desired burst firing signal or phase angle signal. Using a burst firing technique, the process controller can be programmed to give a square wave output with the optimum number of on and off periods to achieve a desired power output. For example, for a 50% power output every other cycle is on. The process controller is preferable programmed to give the minimum number of off periods for a desired power setting.

Advantageously, the in-rush current can be limited by having the starting point for firing other than at the zero voltage of each switching cycle. A range of from 60° to just less than 90° has been found to be advantageous. A starting point of around 60° has been found to be preferable. The successive starting points for burst firing should be in the opposite half cycle to the finishing point.

The preferred power switch is a solid state opto-coupled switch device. The same power switch may be used and operated on a burst firing or phase angle basis. The process controller may be part of a microprocessor device which is incorporated within the operating controls of the device accommodating the magnetron. One process controller may be used to control a number of magnetrons by way of a respective (solid state) power switch. The process controller is programmed with software which controls the generation of the firing signals to give the desired timing of the signals to control switching of the power switch to give the desired power output.

Another aspect of the invention provides a microwave hearing system comprising a magnetron incorporating the aforedescribed control circuit The invention also provides a magnetron microwave power output controller for controlling the current flow in a magnetron, the controller comprising a solid state power switch, an a/c. input connection, first and second transformers, and a process controller/firing circuit for controlling adjustably the operation of the solid state power switch to control a signal applied to the second transformer to control the power generated by the magnetron.

The process controller/firing circuit may output phase angle control signals or burst firing control signals.

Accordingly, an embodiment of the present invention provides a magnetron microwave power output controller for controlling the current flow in a magnetron, the controller comprises a pair of inversely connected thyristors, a half wave blanking power controller for blanking or turning off each thyristor during its non-conducting half of each cycle, and an adjustable control device for the half wave blanking power controller.

In one embodiment the controller further comprises a snubber network. The snubber network is disposed in parallel to the pair of inversely connected thyristors.

Another aspect of the invention provides a microwave heating system comprising a magnetron in combination with a magnetron power output controller as aforedescribed.

The power controller according to the invention controls the current flow in the magnetron. The controller has been specifically designed to cope with a high inductive load. A preferred embodiment has a pair of inversely connected thyristors and a snubber network, each thyristor is blanked or turned off during its non conducting half of each cycle of the mains. More particularly the current is controlled by using a phase angle power controller in series with the primary winding of the power transformer. In order to withstand the high transient loads we use thyristors which are each rated at 1200 volts peak. The preferred drive device comprises 2600 volt opti-coupled steering diodes (triacs). The power level can be difficult to set where the controller operates over a small percentage of the control potentiometer range, say between 45 and 85%. The present invention addresses the problem by increasing the resolution over the control range. This is done using a look up table stored in a microprocessor memory with the aim of giving a linear power output from the manual control potentiometer. A separate transformer is provided to maintain the desired ac. voltage across the magnetron. The controller according to the invention makes possible a smooth proportional linear power regulation from zero to full output using either a manually controlled potentiometer or from a remote signal—say operating at between 0 to 5 volts. Conveniently a voltage feed back input is employed. Advantageously a feed back system measuring stray radiation is used to automatically control the power settings to allow for vastly differing sizes of products to be cooked.

The main advantage of this invention is to provide an infinitely variable power output setting to a microwave oven. The ability to precisely set the power output levels will allow the user to simmer liquids and will allow for profiled temperature control.

BRIEF DESCRIPTION OF THE DRAWINGS

The present invention will now be described further hereafter by way of example only with reference to the accompanying drawings in which:

FIG. 1 illustrates a magnetron at 1, a power regulator comprising the components within the dotted outline 3 and described further hereinafter. A first transformer 7 to maintain a prescribed constant ac. voltage across the magnetron, and a power transformer 9. A control potentiometer is shown at 5. Also shown is resistor R1, diode D1 and capacitors C1, C2.

DESCRIPTION OF THE INVENTION

Figure 1:
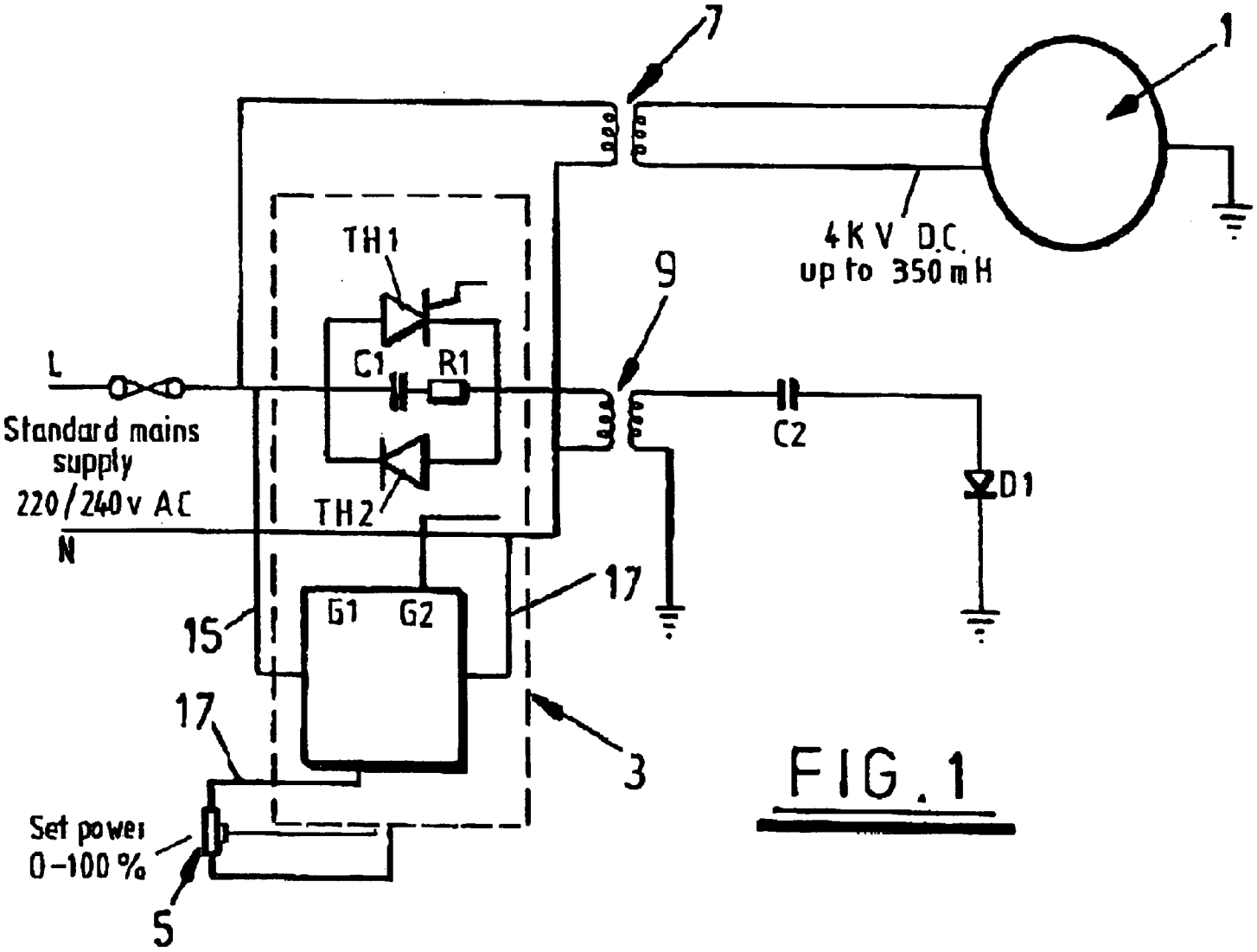
FIG. 1 is a circuit diagram for a proportionally controlled microwave oven.

The power regulator comprises a pair of inversely parallel connected thyristors TH1; TH2 and a half wave blanking power controller 13. The capacitor C1 and the resistor R1 are connected in series with one another and in parallel with the thyristors TH1, TH2. The live and neutral lines are referenced L and N respectively. The supply will usually be a standard 220/240 V a.c. supply.

The half wave blanking power controller 3 is connected across the live and neutral lines by connections 15 and 17. A line 19 connects the manual potentiometer 5 into the half wave blanking power controller 3 and serves to set the desired power output level from 0 to 100%. The current is controlled using a phase angle power controller in series with the primary winding of the power transformer. One skilled in the art will be fully familiar with the function of the half wave blanking power controller and its construction and accordingly it is not deemed necessary to describe it in further detail. However, in the context of the present invention the circuitry includes a micro processor (not illustrated), which stores —say as a look up table —conversion data to linearise the response of the control potentiometer. That is to say equal incremental movements of the potentiometer through its movement range gives rise to equal incremental increases in power output. The preferred arrangement provides a continuously variable stepless power adjustment between 0–100%. Noise on commencement of each firing cycle can be avoided with phase angle triggering, by having a gradual start using a small wave form to limit in-rush current The invention has been described above in relation to the use of a firing circuit which operates on a phase angle basis. In an alternative embodiment, a burst firing technique is employed. The firing circuit generates a pulsed square wave at a frequency necessary to achieve a desired power output between zero and full power. The firing circuit is programmed with an algorhythm to determine the number of on and off cycles to achieve the desired power output. In the preferred example the time base varies and the algorhythm selects the ratio on the basis of the minimum of off periods.

What is claimed is:

1. A control circuit for a magnetron, the circuit being supplied from a source of a.c. voltage and comprising a power switch, a process controller/firing circuit for the power switch, characterised in that the circuit further comprises separate first and second transformers, the first transformer (7) supplies a desired filament voltage to the magnetron (1), and the second transformer (9) controls the current flow in the magnetron and hence the power output thereof, the second transformer being controlled by the operation of the process controller/firing circuit (3) and the power switch, and wherein the power switch comprises a pair of inversely connected back to back thyristors (TH1, TH2) and the process controller/firing circuit comprises a half wave blanking power controller whereby control of the second transformer and hence control of the power output of the magnetron is achieved using a phase angle technique and wherein in-rush current is limited by having the starting point for firing other than at the zero voltage of each switching cycle.

2. A control unit as claimed in claim 1 in which only the second transformer is switched to control the power output.

3. A control unit as claimed in claim 1 in which control of the second transformer and hence the power output of the magnetron is achieved using burst firing technique.

4. A control unit as claimed in claim 3 in which for a burst firing technique, the process controller is programmed to give a square wave output with the optimum number of on and off periods to achieve a desired power output.

5. A control unit as claimed in claim 4 in which the process controller is programmed to give the minimum number of off periods for a desired power setting.

6. A control unit as claimed in claim 3 in which in-rush current is limited by having the starting point for firing other than at the zero voltage of each switching cycle.

7. A control unit as claimed in claim 6 in which a starting point in the range of from 60° to just less than 90° is used.

8. A control unit as claimed in claim 7 in which the starting point is at 600°.

9. A control unit as claimed in claim 3 in which successive starting points for burst firing are in the opposite half cycle to the finishing point.

10. A control unit as claimed in claim 1 in which control of the second transformer and hence control of the power output of the magnetron is achieved using a phase angle technique.

11. A control unit as claimed in claim 1 in which the power switch is a solid state opto-coupled switch device.

12. A control unit as claimed in claim 1 in which the process controller is part of a microprocessor device which is incorporated within the operating controls of the device accommodating the magnetron.

13. A control unit as claimed in claim 12 in which one process controller is used to control a number of magnetrons by way of a respective (solid state) power switch.

14. A control unit as claimed in claim 1 in which the process controller is programmed with software which controls the generation of the firing signals to give the desired timing of the signals to control switching of the power switch to give the desired power output.

15. A microwave heating system comprising a magnetron incorporating a control circuit according to claim 1.

16. A magnetron microwave power output controller for controlling the current flow in the magnetron, the controller comprising a solid state power switch in the form of a pair of inversely connected back to back thyristors (TH1, TH2), an a/c. input connection, first and second transformers (7, 9), and a process controller/firing circuit (3) for controlling adjustably the operation of the solid state power switch to control a signal applied to the second transformer to control the power generated by the magnetron (1), the process controller/firing circuit comprises a half wave blanking power controller for blanking or turning off each thyristor during its non-conducting half of each cycle, and an adjustable control device for the half wave blanking power controller whereby control of the second transformer and hence control of the power output of the magnetron is achieved using a phase angle technique and wherein in-rush current is limited by having the starting point for firing other than at the zero voltage of each switching cycle.

17. A magnetron microwave power output controller as claimed in claim 16 in which the process controller/firing circuit outputs phase angle control signals or burst firing control signals.

18. A magnetron microwave power output controller for controlling the current flow in the magnetron, the controller comprises a power switch in the form of a pair of inversely connected back to back thyristors (TH1, TH2), first and second transformers, a half wave blanking power controller for blanking or turning off each thyristor during its non-conducting half of each cycle, and an adjustable control device for the half wave blanking power controller whereby control of the second transformer and hence control of the power output of the magnetron is achieved using a phase angle technique and wherein in-rush current is limited by having the starting point for firing other than at the zero voltage of each switching cycle.

19. A controller as claimed in claim 18 and further comprising a snubber network which is disposed in parallel to the pair of inversely connected thyristors.

20. A microwave heating system comprising a magnetron in combination with a magnetron power output controller according to claim 18.

21. A power controller according to claim 18 in which each thyristor is blanked or turned off during its non conducting half of each cycle of the mains and the current is controlled by using a phase angle power controller in series with the primary winding of the power transformer.

22. A controller as claimed in claim 21 in which the power switch comprises 2–600 volt opto-coupled triacs with steering diodes.

23. A controller as claimed in claim 22 in which the resolution is increased over the control range to aid power setting.

24. A controller as claimed in claim 23 in which the resolution is increased using a look up table stored in a microprocessor memory with the aim of giving a linear power output from the manual control potentiometer.

* * * * *